United States Patent [19]

Condolios

[11] 4,249,828

[45] Feb. 10, 1981

[54] APPARATUS FOR MAINTAINING SOLIDS IN A SUSPENSION AND A METHOD OF USING IT

[75] Inventor: Elie Condolios, Grenoble, France

[73] Assignee: Alsthom-Atlantique, Paris, France

[21] Appl. No.: 940,232

[22] Filed: Sep. 7, 1978

[30] Foreign Application Priority Data

Sep. 13, 1977 [FR] France ..... 77 27596

[51] Int. Cl.[3] ..... B01F 3/04; B01F 3/08; B01F 7/20

[52] U.S. Cl. ..... 366/102; 366/169; 366/178; 261/87

[58] Field of Search ..... 261/87; 209/169; 210/220, 221; 366/102, 152, 151, 160, 169, 170, 172, 178, 182

[56] References Cited

U.S. PATENT DOCUMENTS

| | | | |
|---|---|---|---|
| 2,609,189 | 9/1952 | Dering | 261/87 |
| 2,996,287 | 8/1961 | Audran . | |
| 3,326,536 | 6/1967 | Zingg et al. | 366/17 |
| 3,414,245 | 12/1968 | Frazer | 366/102 |
| 3,496,881 | 2/1970 | Bylsma . | |
| 3,744,765 | 7/1973 | Bard | 261/87 |
| 3,826,476 | 7/1974 | Ahrenberg | 366/17 |
| 3,911,064 | 10/1975 | McWhirter et al. | 261/87 |
| 4,066,722 | 1/1978 | Pietruszewski | 261/87 |
| 4,100,610 | 7/1978 | Johnston et al. | 366/102 |

*Primary Examiner*—Billy S. Taylor

*Attorney, Agent, or Firm*—Sughrue, Rothwell, Mion, Zinn and Macpeak

[57] ABSTRACT

Apparatus for maintaining solids in suspension in a liquid mass contained in a vat. Liquid under pressure and compressed gas are injected simultaneously into the liquid by the stirrer arm at the bottom of the vat.

11 Claims, 2 Drawing Figures

APPARATUS FOR MAINTAINING SOLIDS IN A SUSPENSION AND A METHOD OF USING IT

FIELD OF THE INVENTION

The invention relates to apparatus for maintaining solids in a suspension in a body of liquid contained in a vat and to a method of using the apparatus.

BACKGROUND OF THE INVENTION

In numerous industrial manufacturing processes, treatments and even handling operations, circumstances lead to solids being put in a suspension in a liquid. This is generally done by permanently stirring the liquid and its contained solids in a vat. But when stirring is stopped, either accidentally or purposely because of production needs, the solids settle, then compact and even harden on the bottom of the vat if the stoppage period is long. This subsequently hinders further stirring to return the deposited solids into suspension.

Therefore, in some processes, devices are used which inject air into the bottom part of the vat; this, however, has the disadvantage of stirring the body of liquid non-homogenously.

In other processes, devices are used which inject liquid under pressure by means of rotating arms. But on starting, the torque remains very high and further, it is sometimes very difficult to get solids (especially granular solids) into suspension.

Further, in order to limit the cumulative effect of such deposits, vats with conical bottoms are used, thereby complicating the manufacture of the vats and of their foundations, especially when they are of large size.

The invention aims to produce apparatus which facilitates putting solids into suspension in a body of liquid contained in a vat and keeping the solids in suspension. The apparatus should also facilitate the use of large, flat-bottomed vats. The invention also relates to a method of using such apparatus.

SUMMARY OF THE INVENTION

The invention provides apparatus for maintaining solids in suspension in a vat which has a stirrer with rotating arms, the apparatus including means for simultaneously injecting liquid under pressure and compressed gas around the arms.

The arms of the apparatus may be disposed preferentially at the bottom of the vat and parallel to the bottom which may be horizontal.

Preferably an arm of the stirrer includes a longitudinally disposed series of nozzles connected to a tube for supplying the liquid under ;ressure and a series of holes connected to a compressed gas distribution pipe; the holes may be constituted by longitudinal slots. The compressed gas supply pipe should be disposed inside the pipe for supplying the liquid under pressure with said liquid distribution pipe being formed by the casing of the arm.

The compressed gas distribution pipe and the pipe for distributing liquid may be connected to supply pipes via inlet pipes integral with the drive shaft of the arms of the stirrer. The pipe for supplying liquid may be disposed concentrically around the compressed gas supply pipe which constitutes the drive shaft. A by-pass may be disposed between the pipe for supplying liquid under pressure and the compressed gas supply pipe.

Advantageously the apparatus should include a device for measuring the torque of the drive shaft.

With such apparatus, when the device is started there is simultaneous injection of a high flow of liquid under pressure to make the contents of the vat more fluid in the neighbourhood of the arms and compressed gas to make the contents of the vat as a whole progressively more fluid up to the top of the vat. Once the apparatus has started, the flow of liquid is reduced to a low permanent flow injected through the nozzles and through the holes so as to prevent any solids from passing therethrough, and if the torque reaches a first maximum threshold the flow of liquid through the nozzles is increased again.

If the flow of injected liquid reaches a maximum threshold and the torque reaches a second maximum threshold, an extra quantity of the solids contained in the bottom of the vat is removed and should the torque reach a third maximum threshold operation is stopped.

An embodiment of the invention is described by way of example with reference to the accompanying drawings.

DESCRIPTION OF THE PREFERRED EMBODIMENT

Figure 1:
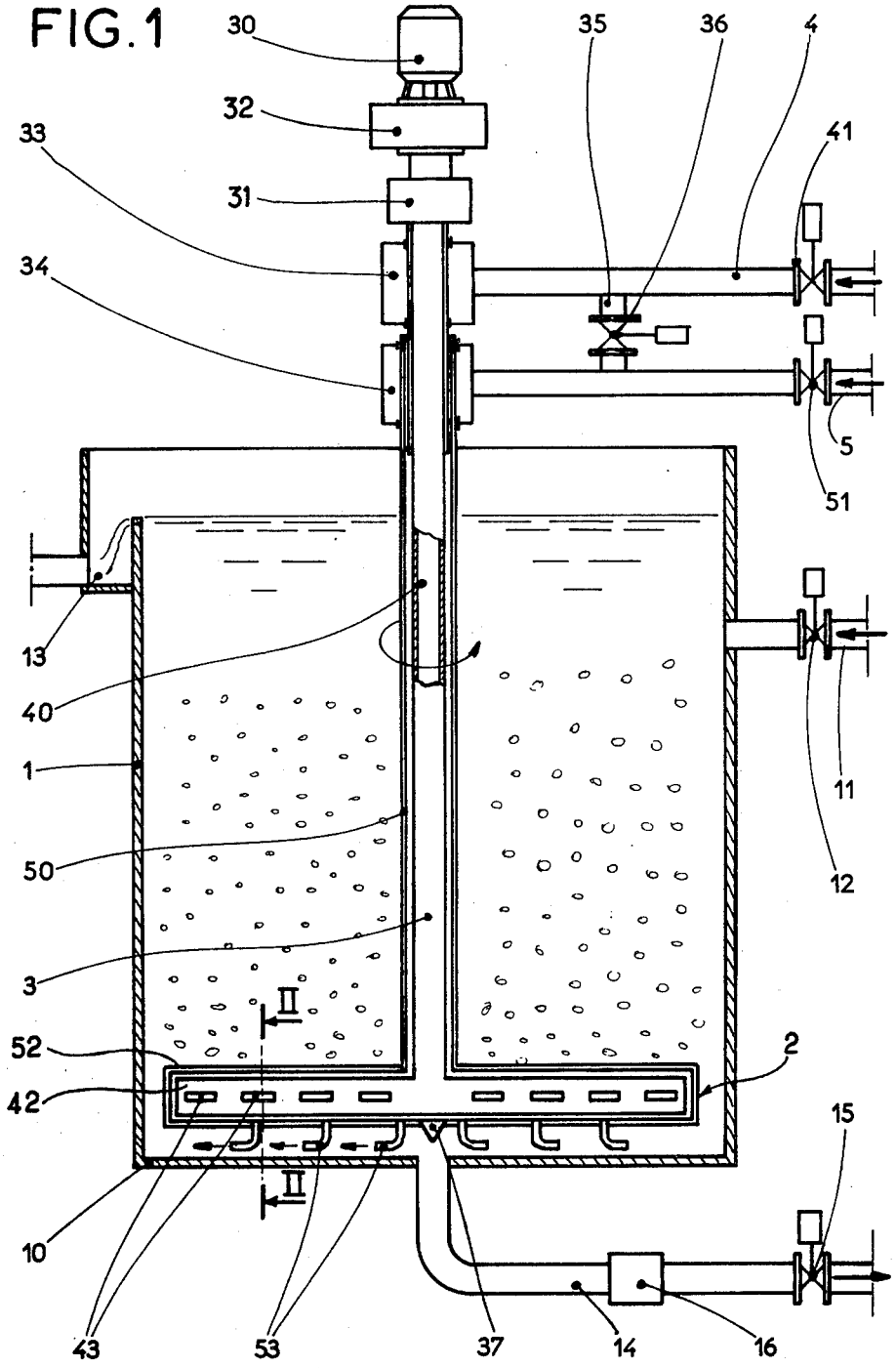
FIG. 1 is a vertical cross-sectional view forming one embodiment of the invention of an apparatus for keeping solids in suspension.
Figure 2:
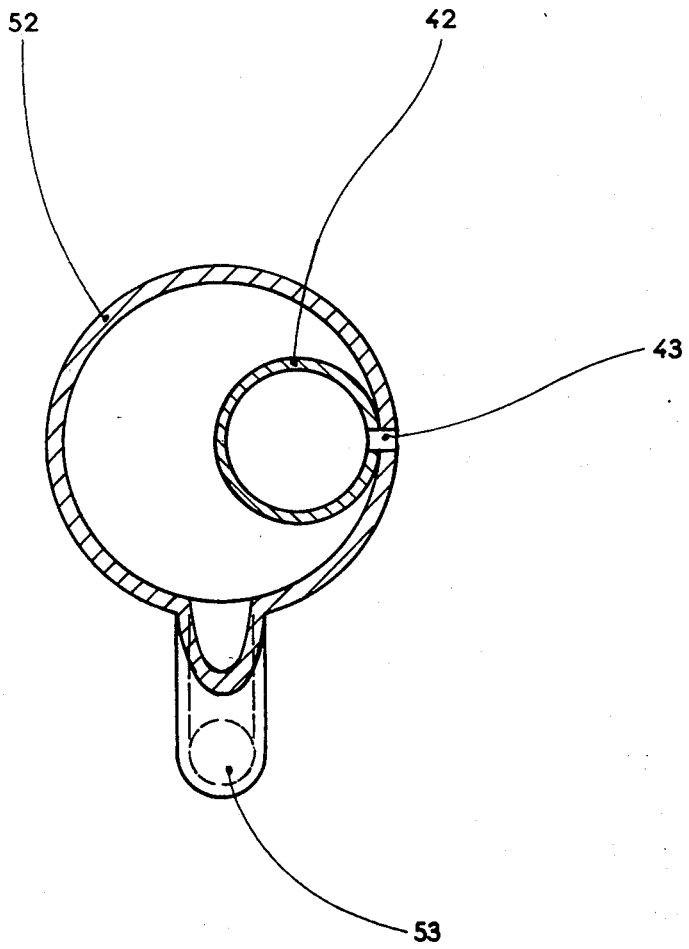
FIG. 2 is a transverse cross-sectional view along line II—II of one arm of the stirrer in FIG. 1.

In the Figures, 1 is a large circular vat with a flat bottom 10; in its upper part the vat has an inlet pipe 11 and a non-return valve 12 for a solid-containing liquid. Near its top, the vat 1 has a spillway 13 for removal of excess liquid. In its lower part it is provided with a pipe 14 in the centre of the bottom 10 for removing the mass contained in the vat. An extraction valve 15 controls the drainage of the solids contained in the vat, the density of the solids optionally being checked by a gamma-densimeter 16.

The vat is further provided in its lower part with horizontal rotating arms 2 disposed parallel to the bottom 10 of the vat and driven from the upper part by a shaft 3 integral withh a variable speed drive motor 30 whose speed is varied by a device 31 for measuring the motor torque. The shaft is supported at the top by a bearing 32 and at the bottom by a shaft step 37.

The drive shaft 3, which is hollow, constitutes an inlet pipe 40 connected by a rotating connection 33 to a compressed gas supply pipe 4, generally supplying air under the control of a valve 41.

Another inlet pipe 50 connected by a rotating connection 34 to a clear liquid supply pipe 5 under the control of a valve 51 is disposed concentrically around the pipe 40.

A by-pass under the control of a valve 36 is disposed downstream from the valves 41 and 51 between the supply pipes 4 and 5.

The arms of the stirrer are formed by two distribution pipes—an outside pipe 52 which constitutes the casing of the arms and is connected to the clear liquid supply pipe 50 and an inside pipe 42 connected to the pipe 40 for supplying compressed gas to the bottom of the vat.

The bottom of the distribution pipe 52 is provided with clear liquid injection nozzles 53. The distribution pipe 42 is disposed tangentially to one of the lateral walls of the pipe 52; compressed gas is injected into the bottom of the vat through horizontal slots 43 cut in both pipes.

With the arrangement thus constituted, operation is as follows:

The liquid which contains solids is brought into the vat 1 via the pipe 12; the spillway 13 removes the excess liquid, while the mass of treated solids is removed via the pipe 14 by opening the valve 16.

After a long stoppage period, when solid deposits have concentrated on the bottom of the filled vat, the compressed gas and clear liquid supply valves 41 and 50 are opened with the valve 36 closed to inject liquid at high pressure through the arms of the stirrer and the drive motor is slowly started. The combined injection of clear liquid and of compressed gas initially fluidizes the contents of the vat in the neighbourhood of the arms and then, step by step, makes the contents of the vat as a whole more fluid, up to the top of the vat, transmitting thereto the initial effect which occurred at the bottom of the vat.

The speed of the motor is increased progressively as a function of the motor torque indicated by the measurement device 31 until it reaches normal speed and then compressed gas injection is stopped once the motor torque has fallen below a first threshold which constitutes a normal maximum value. The valve 36 which controls the by-pass 35 is then opened and, by closing down the valves 51 and 41, the clear liquid supply is reduced so as to allow only a small flow through the nozzles 53 and the slots 43.

However, if the maximum torque exceeds the first threshold, the clear liquid flow is increased.

This flow is then increased up to a maximum and the motor torque must be maintained below a second motor torque maximum threshold.

Above the second maximum threshold, ann extra quantity of the solids contained in the bottom of the vat is removed by opening the valve 16.

However, if the motor torque reaches a third maximum threshold, operation must be stopped.

It is obvious that the invention is in no way limited to the embodiment which has just been described and illustrated and which has been given only by way of example; in particular, the invention may be used for stirring in vats with conical bottoms.

I claim:

1. Apparatus for maintaining solids in suspension in a vat, said apparatus including a stirrer having rotating arms positioned within said vat, a source of liquid under pressure, a source of compressed gas, the improvement wherein said rotating arms comprise concentric, spaced inner and outer tubes, means for connecting said source of liquid to said space between said inner and outer tubes and said compressed gas source to said inner tube, and said inner and outer tubes containing aligned holes at longitudinally spaced positions along the complete length thereof and about the periphery of said tubes for simultaneously injecting liquid under pressure and compressed gas into said suspension as said arms rotate.

2. Apparatus according to claim 1, wherein the arms of the stirrer are disposed at the bottom of the vat.

3. Apparatus according to claim 2, wherein the arms extend parallel to the bottom of the vat.

4. Apparatus according to claim 3, wherein the bottom of the vat is horizontal.

5. Apparatus according to claim 1, wherein each arm of the stirrer has said outer tube bearing a series of longitudinally spaced nozzles connected to said liquid source for supplying the liquid under pressure.

6. Apparatus according to claim 5, wherein the compressed gas injection holes are constituted by longitudinal slots.

7. Apparatus according to claim 6, wherein the compressed gas distribution tube and the tube for distributing the liquid are connected to supply pipes via inlet pipes constituting a drive shaft connected to the arms of the stirrer.

8. Apparatus according to claim 7, wherein the tube for supplying the liquid is disposed concentrically around the compressed gas supply tube which constitutes the drive shaft.

9. A method for maintaining solids in a suspension in a vat including a stirrer having rotating arms within said vat, said method comprising the steps of:

injecting during starting of the stirrer at high volume liquid under pressure along the length and about the periphery of the rotating arms to fluidize the contents of said vat, simultaneously injecting compressed gas along the length of said rotating arms and about the periphery thereof to progressively increase the fluidity of the contents of said vat as a whole from the bottom to the top of said vat, said rotating arms being provided with nozzles and holes, and said method further comprising the steps of after the apparatus is started, reducing the flow of liquid to a low permanent flow by injecting said flow through said nozzles and said holes to prevent any solids from passing therethrough, and increasing the flow of liquid through said nozzles again if the torque reaches a first maximum threshold.

10. A method according to claim 9, further comprising the step of removing an extra quantity of the solids contained in the bottom of the vat if the flow of injected liquid reaches a maximum threshold and the torque reaches a second maximum threshold.

11. A method according to claim 10, further comprising the step of terminating the operation of the stirrer should the torque reach a third maximum threshold.

* * * * *